US005706533A

United States Patent [19]

Opheim et al.

[11] Patent Number: 5,706,533

[45] Date of Patent: Jan. 13, 1998

[54] QUADRANTAL CRIB WITH CANOPY AND SLIDING GATE

[76] Inventors: Don G. Opheim; Sue R. Opheim, both of Rt. 1, Box 649-A, Lubbock, Tex. 79401

[21] Appl. No.: 819,450

[22] Filed: Mar. 17, 1997

[51] Int. Cl.[6] ..... A47D 7/00; A47D 7/02

[52] U.S. Cl. ..... 5/99.1; 5/93.1; 5/100; 5/97; 5/414; 5/902; D6/391

[58] Field of Search ..... 5/99.1, 93.1, 902, 5/100, 414, 97; D6/390, 391

[56] References Cited

U.S. PATENT DOCUMENTS

| | | | |
|---|---|---|---|
| D. 378,789 | 4/1997 | Morris | D6/391 |
| 2,308,608 | 1/1943 | Kennedy | 5/99.1 |
| 2,650,375 | 9/1953 | Serrell | 5/99.1 |
| 2,689,960 | 9/1954 | Lax | 5/100 |
| 2,913,739 | 11/1959 | White | 5/99.1 |
| 3,165,759 | 1/1965 | O'Daniell | 5/93.1 |
| 3,430,271 | 3/1969 | Junod-Deile | 5/93.1 |
| 3,863,279 | 2/1975 | Stalder | 5/8 |
| 3,886,607 | 6/1975 | Dunn | 5/104 |
| 3,890,658 | 6/1975 | Petersilie | 5/12.1 |
| 4,043,349 | 8/1977 | Gays et al. | 5/97 |
| 4,046,421 | 9/1977 | Spound et al. | 5/131 |
| 4,433,447 | 2/1984 | Mathou | 5/93.1 |
| 4,765,004 | 8/1988 | Kessel | 5/99.1 |

*Primary Examiner*—Alexander Grosz
*Attorney, Agent, or Firm*—Richard C. Litman

[57] ABSTRACT

A foldable quadrantal corner baby crib including five wheeled posts, a crib floor and top interconnecting frame pieces. The quadrantal crib has the versatility to be placed in a corner of the baby room and is safe in use. Another attribute is the facility of multiple cribs being grouped in a bedroom for multiple births while minimizing the space occupied by the cribs. Only nine fasteners are required for assemblage and disassemblage of the canopy framed crib. When folded, the crib can be stored under a bed.

10 Claims, 4 Drawing Sheets

QUADRANTAL CRIB WITH CANOPY AND SLIDING GATE

BACKGROUND OF THE INVENTION

1. Field of the Invention

The present invention relates to a folding quadrantal corner baby crib capable of quick assembly and disassembly by the parent for storage under a bed. The quadrantal crib permits maximum use of space in a baby's bedroom, which advantage is further maximized with multiple cribs in one room. The two solid sides minimize injury of the infant by pinching against the wall in a corner if a conventional fence with spaced bars is utilized.

2. Description of Related Art

The related art shows folding portable cribs, triangular play pens, and the grouping of furniture in a right-angled corner, but fail to remotely suggest the present invention of a folding quadrantal corner baby crib which can be assembled and disassembled with a minimum of fasteners which a baby occupant cannot reach. The related art fails to suggest how such a number of cribs can be assembled in a room with the advantage of a minimum space requirement.

The related art will be discussed in the order of their perceived relevance to the present invention.

U.S. Pat. No. 4,765,004 issued on Aug. 23, 1988, to Jason H. Kessel describes a folding portable crib of the usual rectangular shape wherein the hinged sides fold inwardly to form a compact stack. The side hinges are non-linear to provide an inward bias to prevent undue flexing of the joint when the crib is occupied. The crib is held open by the tightly fitting bottom. The sides are attached to the ends of the crib by brackets of unequal length necessary for folding. There is no suggestion for modifying the shape of the rectangular crib to a quadrantal configuration as in the present invention.

U. S. Pat. No. 4,433,447 issued on Feb. 28, 1984, to Marcel Mathou describes a triangular shaped play pen having three corner posts with each post having upper and lower damping elements and freely pivoting wheels. The side bars are plastic tubes having a wooden core corners, which ends thereof are flattened and secured to the plastic sheathed metal or wood cored posts with a nut and washer assembly. The floor is apparently not fixed. There is no suggestion for utilizing wing nuts for faster assembly and disassembly. The use of damping elements (bumpers) on the posts suggest movement of the crib about the room is accepted instead of placement in a corner of a bedroom.

U.S. Pat. No. 3,430,271 issued on Mar. 4, 1969, to Marie-Louise Junod-Deile describes a flexible, triangular shaped and inflatable child's play pen which is transportable. The base and the hand rail are inflated tubes with connecting bars and a bottom of an elastic material. There is no suggestion for forming a quadrantal inflexible but foldable corner baby crib.

U.S. Pat. No. 3,886,607 issued on Jun. 3, 1975, to Troy Dunn describes a collapsible play crib for babies and small children, wherein the body portion may be oscillated vertically and rotated horizontally simultaneously. There is no suggestion for forming a foldable quadrantal corner baby crib.

U.S. Pat. No. 3,863,279 issued on Feb. 4, 1975, to Fritz Stalder describes a piece of furniture for a right-angled corner of a room comprising at least two bodies being shiftable in a common frame and characterized by a draw and push mechanism. There is no suggestion for forming a foldable corner baby crib.

U.S. Pat. No. 3,890,658 issued on Jun. 24, 1975, to Frank W. Petersilie describes a fold-open convertible occupant-receiving unit of furniture for use as a sofa, chair or the like. There is no suggestion for forming a foldable quadrantal corner baby crib.

U.S. Pat. No. 3,165,759 issued on Jan. 19, 1965, to Oscar O'Daniell describes an inflated amusement device having a triangular shape to fit a corner of a playpen. There is no suggestion for forming a foldable quadrantal corner baby crib.

U.S. Pat. No. 4,046,421 issued on Sep. 6, 1977, to Albert M. Spound et al. describes a modular article of furniture capable of assuming a variety of shapes and configurations having at least one body support structure, one seatrest unit, and one releasably associated upper body. There is no suggestion for forming quadrantal baby cribs with this modular furniture.

None of the above inventions and patents, taken either singularly or in combination, is seen to describe the instant invention as claimed. Thus a corner crib solving the aforementioned problems is desired.

SUMMARY OF THE INVENTION

The invention is a foldable quadrantal corner baby crib including five wheeled posts, a crib floor and top interconnecting frame pieces. The quadrantal crib can be placed in a corner of the baby room and is safe in use, having two walls against the room walls when so placed. Multiple cribs can be grouped in a bedroom for multiple babies while minimizing the space occupied by the cribs. Only nine fasteners are required for assemblage and disassemblage of the canopy framed crib, and, when folded, the crib can be stored under a bed.

Accordingly, it is a principal object of the invention to provide a foldable quadrantal corner baby crib which is simple to assemble, use, disassemble, and store.

It is another object of the invention to provide a foldable quadrantal corner baby crib adaptable to be used in multiples for multiple babies.

It is a further object of the invention to provide a foldable quadrantal corner baby crib with a minimum of dangerous projections and fences with spaced bars.

Still another object of the invention is to provide a foldable quadrantal corner baby crib which maximizes the available space in a bedroom.

It is an object of the invention to provide improved elements and arrangements thereof in a quadrantal corner baby crib for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a solution to those parents having minimal space for their babies, whether one or more, by providing a quadrantal baby crib which can be placed in a corner and stored in a folded condition under a bed.

Figure 1:
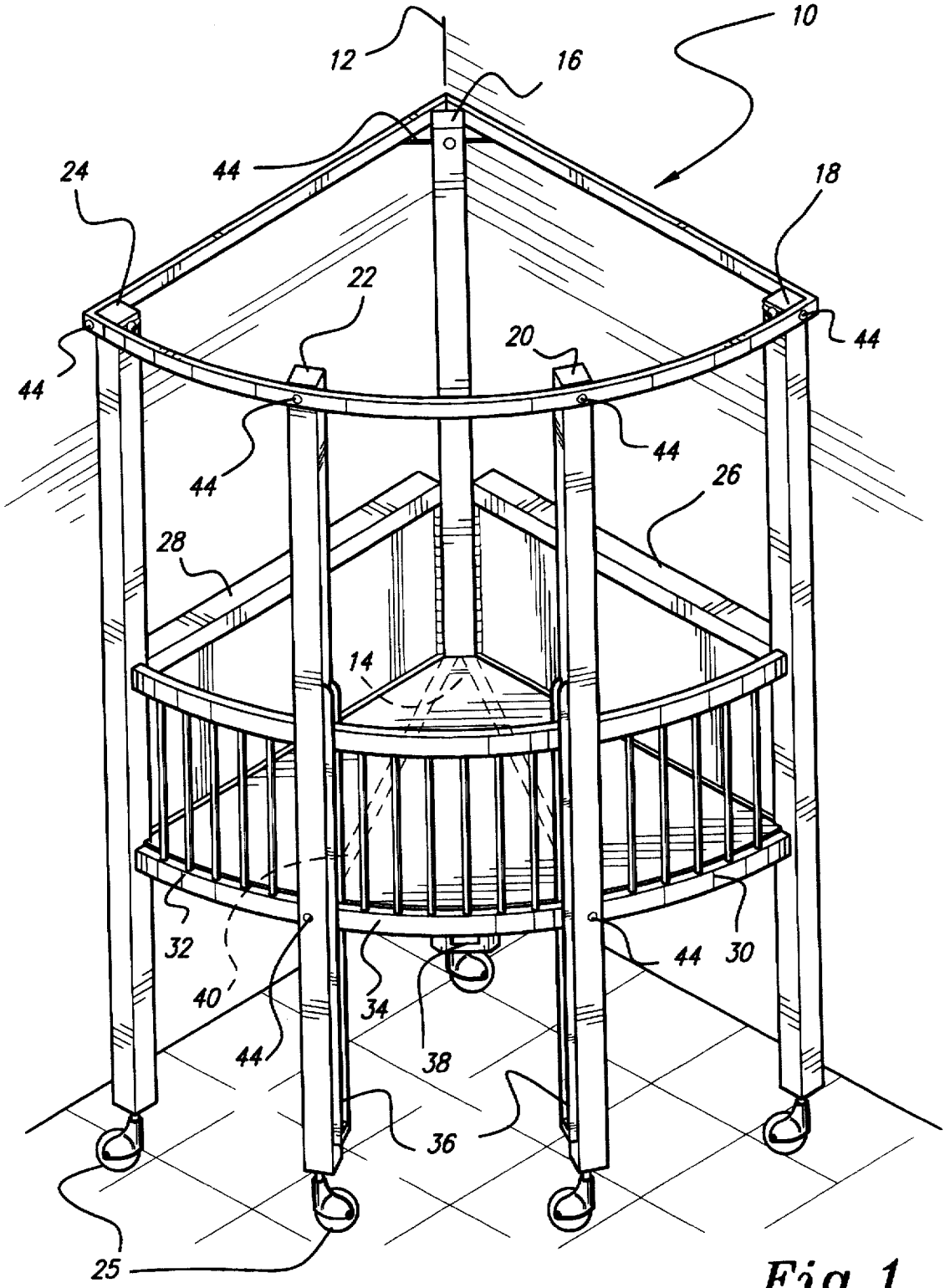
FIG. 1 is a perspective view of the foldable quadrantal corner crib without the mattress and side pads according to the present invention.

In FIG. 1, a crib 10 is situated in a room corner 12 without a mattress and border padding to better show the crib floor 14 which snugly fits within the crib sides. The crib 10 is preferably made of wood and coated except for metal attachment parts, but can be made of plastic or metal. Five upright posts, square in cross-section and approximately six feet in length, are numbered sequentially from the first corner post 16 in the room corner 12 in a clockwise direction to the second corner post 18, first gate post 20, second gate post 22, and the third corner post 24. Each post has a caster wheel 25 which enhances movability of the crib 10. Also, the crib may optionally have brake means (not shown).

The first corner post 16 has first and second straight fence walls 26 and 28, respectively, hinged to it by hinges 29 (see FIGS. 2 and 3) at a midpoint of the post. The opposite ends of these fence walls 26 and 28 are also hinged to the second corner post 18 and the third corner post 24, respectively. The hinges, preferably brass, are as long as the fence walls 26 and 28.

Figure 2:
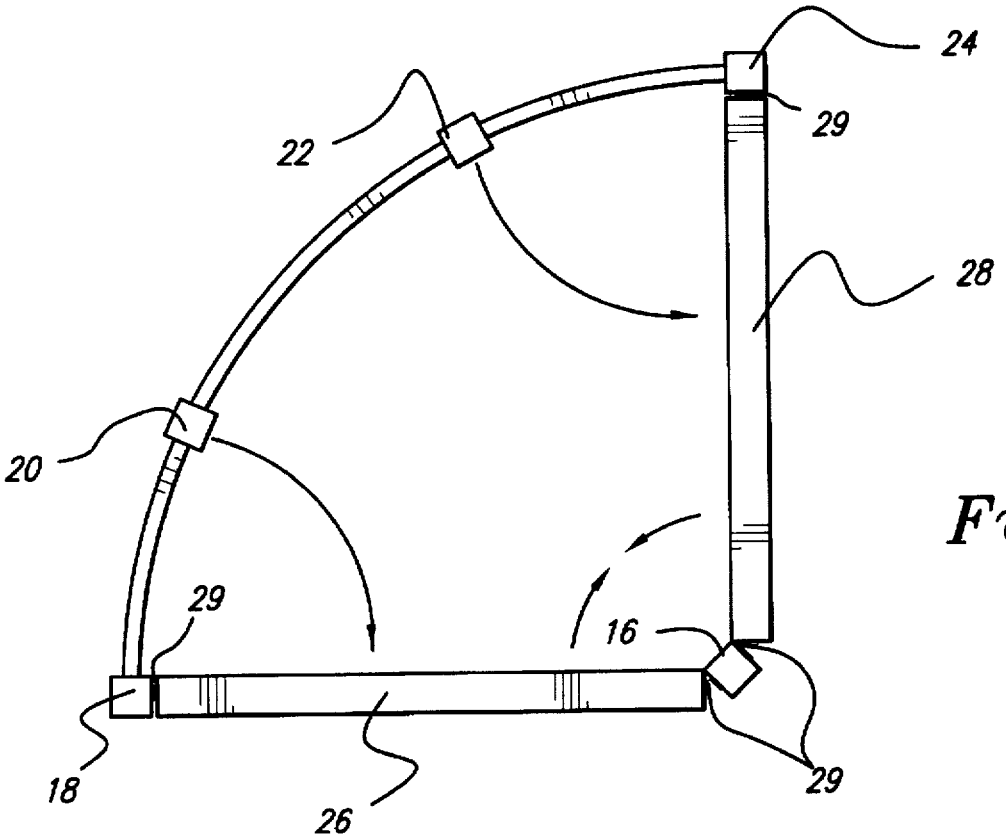
FIG. 2 is a top schematic view of the foldable quandrantal corner crib prior to folding with directional arrows for each fold.
Figure 3:
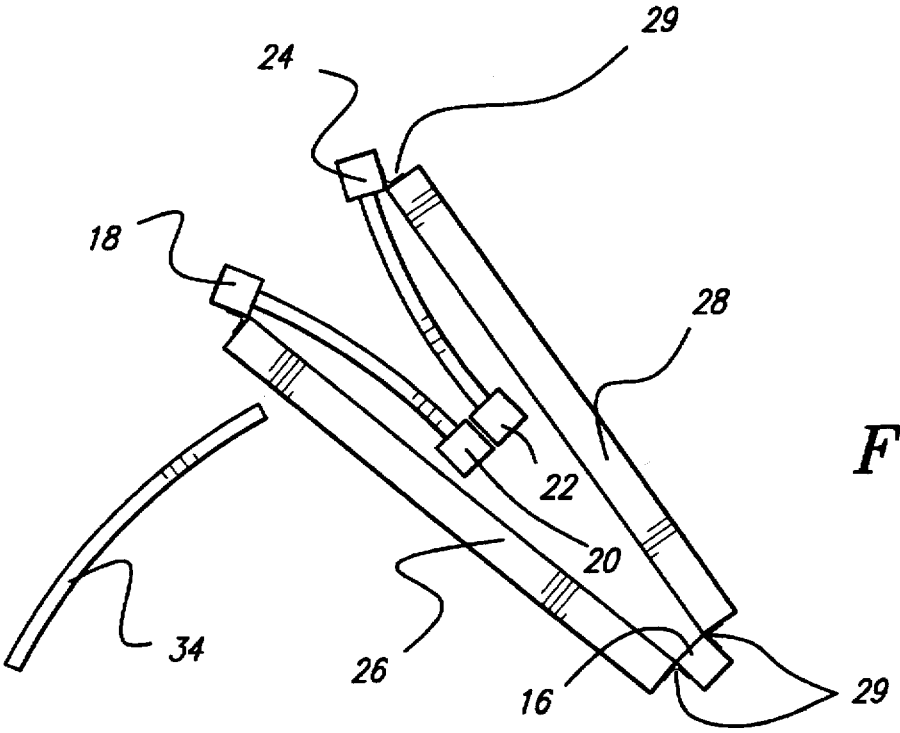
FIG. 3 is a top schematic view of the folded quadrantal corner crib without the crib floor.

The second corner post 18 is hinged to a first curved rail fence 30 as is the third corner post 24 to the second curved rail fence 32 as seen in FIGS. 2 and 3. In FIGS. 1 and 3, a curved but removable rail gate 34 is depicted. In FIG. 1, the gate 34 is slidable in the confining slots 36 formed on posts 20 and 22, said slots being extended below the level of the floor 14 to accommodate the lowering of the gate 34 for any purpose. The gate 34 is maintained in the raised position by a key and slot element 38. The possible removal of the key from its position by the baby is remote. The key and slot element 38 is a portion of a panel which can extend between posts 20 and 22 and is attached to the floor 14.

In the quadrantal baby crib 10, the crib floor 14 is mainly supported by a large V-shaped bracket of a floor brace unit 40 shown in shadow lines with legs extending to the gate posts 20, 22 and having a downwardly projecting peg at the apex of the V which fits in a slot (hidden) formed in the front of the first corner post 16. The bracket legs are attached to the gate posts 20, 22 by bolts (lock washers and wingnuts) as depicted in FIG. 1.

The crib 10 was designed to offer a minimum of dangerous points to the infant occupant in terms of removable small objects, sharp edges, and trapping of fingers between the room wall and the crib's fencing. Therefore, there are only nine fasteners utilized which the baby cannot reach, and the solid panels of the straight fence walls 26 and 28.

The upper ends of the five posts are reinforced with three pieces of a canopy frame 42 attached by bolts, lock washers and wingnuts 44. The first corner post 16 has first and second straight frame piece 46, 48, respectively, fastened to it by a 3.5 in. bolt 44 secured by a lock washer and wingnut (hidden). The opposite ends of frame pieces 46, 48 are fastened, respectively, to the second corner post 18 and the third post corner 24 by smaller length bolts with lock washers and wingnuts 44. Similarly, the curved frame piece 50 is attached to the four outer posts 18, 20, 22, and 24 by similar fastening.

The intent of the present invention is to facilitate the fabrication and taking apart of the quadrantal baby crib by minimizing the number of fasteners and to utilize fasteners not requiring exotic tools. The last two fasteners 44 of the nine required are on the gate posts 20 and 22 as noted above to fasten to the floor brace unit to support the crib floor 14.

Figure 4:
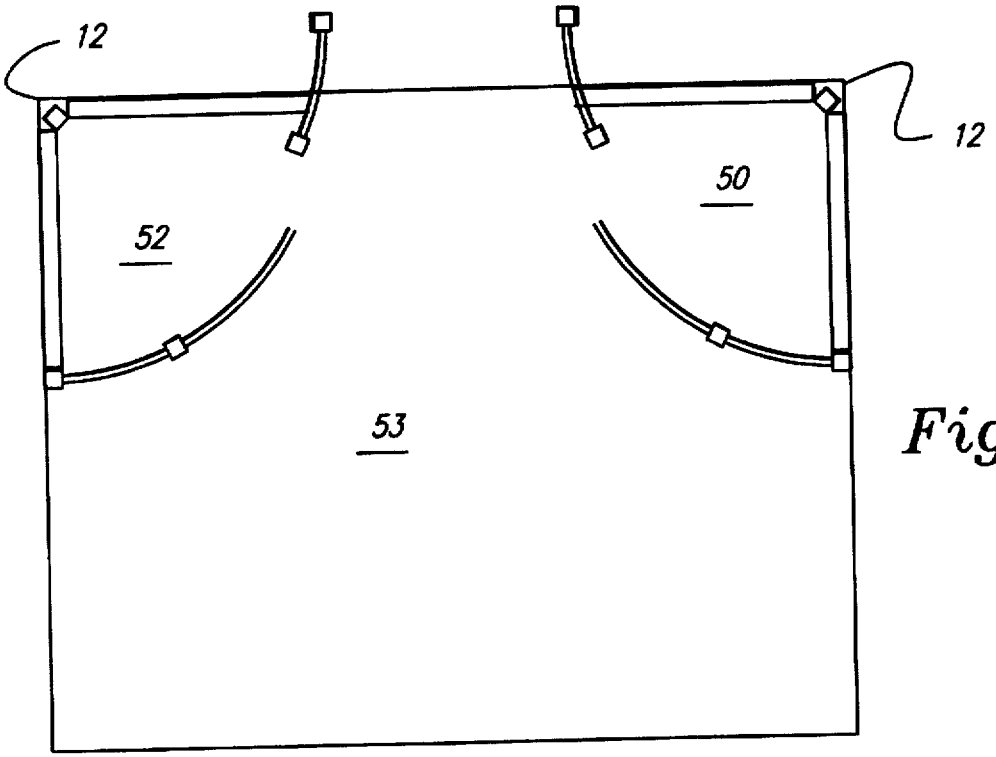
FIG. 4 is a top schematic view of a floor plan for placement of two foldable quadrantal corner cribs for twin babies.
Figure 5:
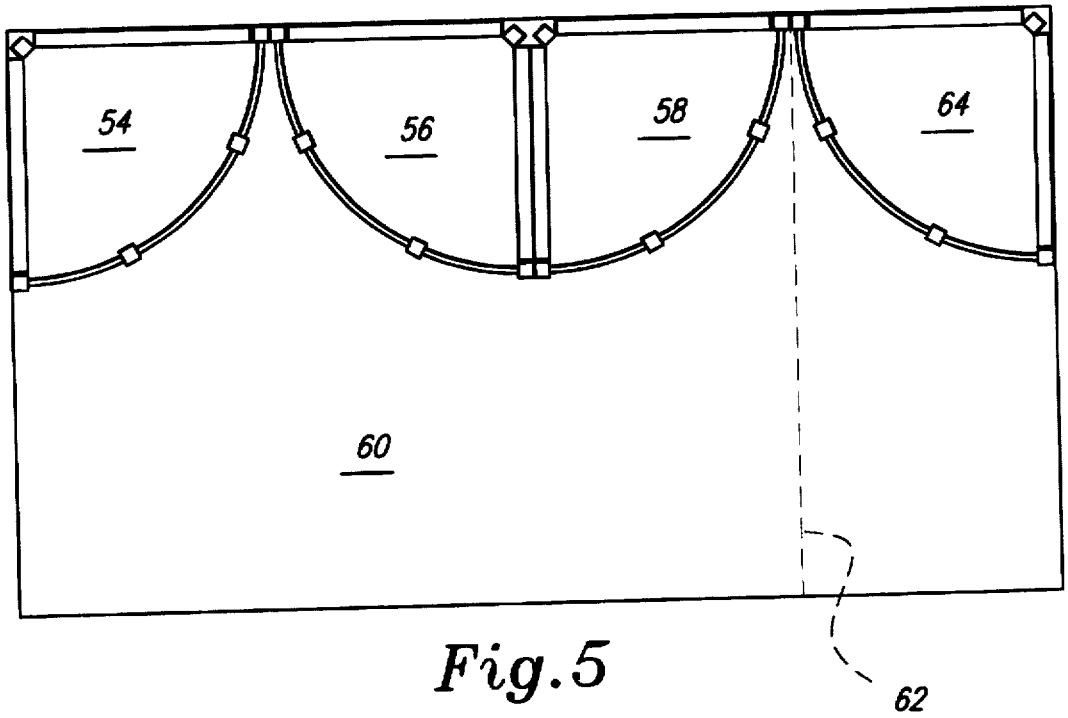
FIG. 5 is a top schematic view of a floor plan for accommodating either triplets or quadruplets with the difference shown by shadow lines.
Figure 6:
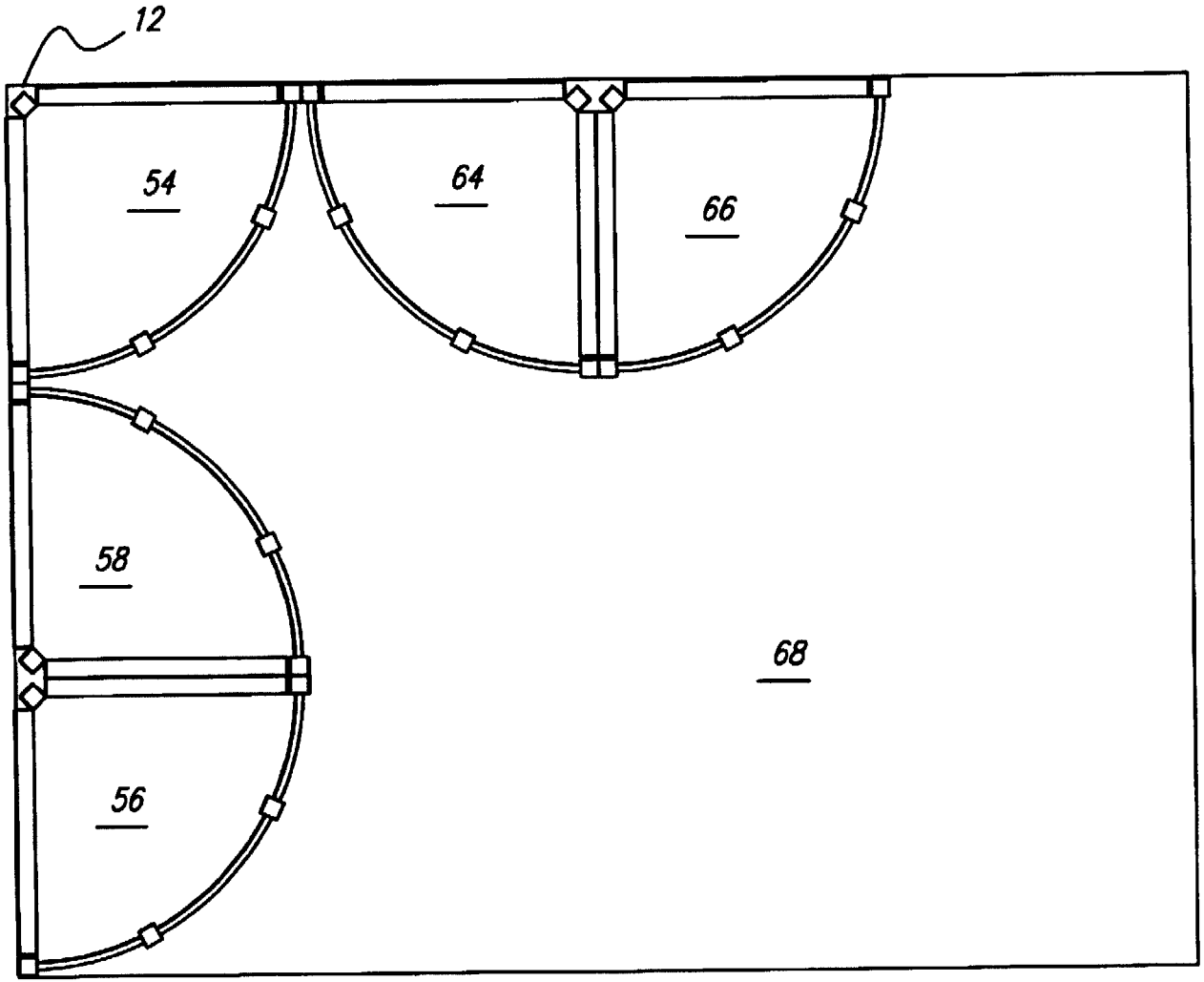
FIG. 6 is a top schematic view of a floor plan for the accommodation of quintuplets.

Turning to FIGS. 4–6, exemplary floor plans for laying out the quadrantal cribs for multiple babies are illustrated. In FIG. 4, twin babies are conveniently accommodated with two quadrantal cribs 50 and 52 in adjacent corners 12 of a room 53. It can be readily observed that a minimum of space is required which permits space for other furniture in the room. In FIG. 5, an arrangement of quadrantal cribs 54, 56, and 58 are arranged in a room 60 bordered by a shadow line 62 for triplets. If another quadrantal crib 64 is required for quadruplets, the room 66 can accommodate the fourth quadrantal crib as shown in FIG. 5 conveniently along one wall. Finally, quintuplets can be accommodated in the floor plan of FIG. 6 with the addition of a fifth quadrantal crib 66. It should be noted that this arrangement particularly emphasizes the saving of space for five cribs and the accessibility of the parents to each infant.

Although the decorative value of adorning the canopy frame with colored drapery which can even be extended down each post to the floor for aesthetic reasons has not been illustrated, it is within the ambit of this invention to include this feature.

It is to be understood that the present invention is not limited to the embodiments described above, but encompasses any and all embodiments within the scope of the following claims.

We claim:

1. A foldable quadrantal corner baby crib comprising:

five upright posts situated in a quadrant with three adjacent posts being corner posts forming the sides of a right angle and two included gate posts;

said three adjacent posts hingedly connected by two straight fence walls at their midpoints, and said two included gate posts hingedly connected by two respective curved rail fences to adjacent corner posts at their midpoints, respectively;

a removable curved slidable rail gate positioned between said two included gate posts for permitting access;

an elevated crib floor configured in a quadrant to abut against said five upright posts, said straight fence walls, said curved rail fences, and said curved slidable rail gate; and a quadrantal canopy frame removably positioned at the top ends of the five upright posts;

whereby the foldable corner baby crib can be folded by removing the quadrantal canopy frame, the crib floor, and the removable curved slidable rail gate for storage and movement to another area.

2. The quadrantal corner baby crib according to claim 1, wherein wingnuts and bolts are provided, the quadrantal canopy frame being connected by said wingnuts and said bolts to the five upright posts.

3. The quadrantal corner baby crib according to claim 1, wherein the three upright corner posts have hinges connected to the straight fence walls and the curved rail fences for folding.

4. The quadrantal baby crib according to claim 1, wherein the crib floor is supported by V-shaped brackets having a downwardly projecting peg which fits in a slot in each of said three adjacent posts.

5. The quadrantal corner baby crib according to claim 1, wherein each of said five upright posts has a caster wheel at its foot.

6. The quadrantal corner baby crib according to claim 1, wherein a key in a slot of the crib floor locking element prevents lowering of the revolvable curved slidable rail gate.

7. The quadrantal corner baby crib according to claim 1, wherein the removable curved slidable rail gate is confined in slots in each of the two included gate posts.

8. The quadrantal corner baby crib according to claim 1, wherein a mattress commensurate in shape with the shape of the quadrantal crib floor is located above and on the crib floor.

9. The quadrantal corner baby crib according to claim 1, wherein nine bolts with wingnuts and washers are provided for assembly and disassembly of the foldable corner crib.

10. The quadrantal corner baby crib according to claim 1, wherein the folded corner crib is configured and dimensioned so that it can be stored under a bed.

* * * * *